US007039964B2

(12) United States Patent
Cavanagh

(10) Patent No.: US 7,039,964 B2
(45) Date of Patent: May 9, 2006

(54) ROLL-ABOUT POWERIZED TOILET SEAT LIFT

(76) Inventor: Bruce J. Cavanagh, 33 Oakland Dr., Jackson, NJ (US) 08527

( * ) Notice: Subject to any disclaimer, the term of this patent is extended or adjusted under 35 U.S.C. 154(b) by 88 days.

(21) Appl. No.: 10/827,878

(22) Filed: Apr. 21, 2004

(65) Prior Publication Data

US 2005/0235414 A1 Oct. 27, 2005

(51) Int. Cl.
*A47K 13/10* (2006.01)

(52) U.S. Cl. ..... 4/667; 4/254; 4/246.1

(58) Field of Classification Search ..... 4/667, 4/254, 246.1; 297/DIG. 10, 327, 330
See application file for complete search history.

(56) References Cited

U.S. PATENT DOCUMENTS

| | | | | |
|---|---|---|---|---|
| 4,888,833 | A * | 12/1989 | Garcia et al. | 4/667 |
| 5,155,873 | A * | 10/1992 | Bridges | 4/667 |
| 5,309,583 | A * | 5/1994 | White et al. | 4/667 |
| 6,161,229 | A * | 12/2000 | Ryan et al. | 4/667 |
| 6,507,961 | B1 * | 1/2003 | Ming-Hwa | 4/667 |
| 6,754,917 | B1 * | 6/2004 | Rhoades | 4/667 |
| 6,811,220 | B1 * | 11/2004 | Shea et al. | 4/667 |

* cited by examiner

*Primary Examiner*—Khoa D. Huynh
(74) *Attorney, Agent, or Firm*—Charles I. Brodsky

(57) ABSTRACT

Apparatus usable in a hospital, nursing home and assisted care facility environment to assist physically impaired persons in sitting down and standing up from a toilet including a frame having a rotatable platform incorporating an integral toilet seat rollable into position above the bowl of a toilet whose seat is raised for use.

17 Claims, 6 Drawing Sheets

ROLL-ABOUT POWERIZED TOILET SEAT LIFT

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

The present invention relates to apparatus for assisting physically impaired persons in sitting down and standing up from a toilet, in general, and to a powerized toilet seat lift usable in a hospital, nursing home and assisted care facility environment, in particular.

2. Description of the Related Art

As will be appreciated, persons having severe arthritis of the hip or knee, or a severe neuromuscular disease such as muscular dystrophy, multiple sclerosis, transverse myelitis and muscle weakness due to amyotrophic lateral sclerosis often require physical assistance in the bathroom, transitioning between seated and upright positions. As will also be appreciated, those suffering from advanced Parkinson's Disease, Guillian Barre or hemiparesis likewise require assistance to decease the stress on the hips and knees in these positionings.

Several types of powerized toilet seat lift devices have been proposed to deal with this—generally operating through a combined system of an air compressor and an air exhaust valve, controlled by the user. Common to all of them is a design intended to promote an independence of operation for the user, while reducing stress on the joints involved. Typical of these devices are those described in U.S. Pat. Nos. 5,661,858, 5,819,325, and 6,154,896.

While these patented designs may well serve their described purposes, by-and-large, they are each intended primarily for independent use, in the home. The power-assisted toilet seat lift of U.S. Pat. No. 6,154,896, for example, is described as being a "heavy duty" assembly employing a stationary frame. The toilet seat lift of U.S. Pat. No. 5,819,325, on the other hand, is fixed to a floor surrounding the toilet and to a back wall—while the power seat lift of U.S. Pat. No. 5,661,858 is one in which its main components are also fixedly attached.

As will be readily understood, however, power toilet-seat lift arrangements are very oftentimes required in a hospital, nursing home and assisted care facility, where concern extends to not only meet the needs of the disabled, but to satisfy OSHA regulations by helping to prevent back injuries to the Caregiver. In particular, a design would be quite beneficial if it enables less staff to be used in transferring a patient, while being one which could easily be moved from room-to-room, from floor-to-floor, for different patient use. Ease of operational use is also an absolute necessity for this as well, as it cannot be expected that maintenance personnel or nursing staff are to bolt or otherwise secure the toilet seat lift apparatus to be effective. Such ability to move the toilet seat lift about, of necessity, requires that it not be overly bulky or heavy, but continue to be one which affords a large lifting characteristic. An ability to accomplish this not only protects the Caregiver, but significantly lessens any claims for compensable work injuries that might follow, thereby reducing insurance costs.

As even a brief reading of U.S. Pat. Nos. 5,661,858, 5,819,325 and 6,154,896 will show, the devices there described exhibit a degree of complexity which it would be desirable to simplify—if only to assure reliability of operation. The numerous linkages which there provide vertical translation, horizontal translation and rotation in general to the powerized seat have been analyzed to be subject to extensive breakdown. What would be desirable, instead, would be a powerized toilet seat which could easily be moved about as a portable unit, while still continuing to be able to assist the handicapped person back to their feet after use. One which would also allow easy cleaning of the seat afterwards would be particularly attractive, as would be one which could be controlled by a user-patient or by the Caregiver-staff, while continuing to maintain the powerized toilet seat apparatus fast to the floor as the toileting progresses. This last feature will be seen to protect the user-patient from accidental injury.

SUMMARY OF THE INVENTION

As will become clear from the following description, the powerized toilet seat lift of the invention is a roll-about unit incorporating a frame with rubberized feet to rest upon the floor when being used, while having appropriate wheels or casters at one end upon which the lift could be moved. A pair of handles at the top of the frame remote from the wheels or casters enable tilting of the frame for rolling simply by lifting up and pushing or pulling. Through the use of an electric control, a motor, a linear actuator and a simple pivot configuration, a toilet seat integrally incorporated within a support platform could be raised or lowered in assisting a user-patient in getting up from the seat, with either or both of the seat and platform being removable for cleansing. An on-off control is effective in starting and stopping the included motor in operating the actuator, and can be coupled at the frame itself or stretched therefrom as a type of remote control unit for the Caregiver-staff attending the patient. As will be seen, in the lowered position, the platform is dimensioned to slide its seat over the bowl of a toilet whose own seat is raised for toileting to begin.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
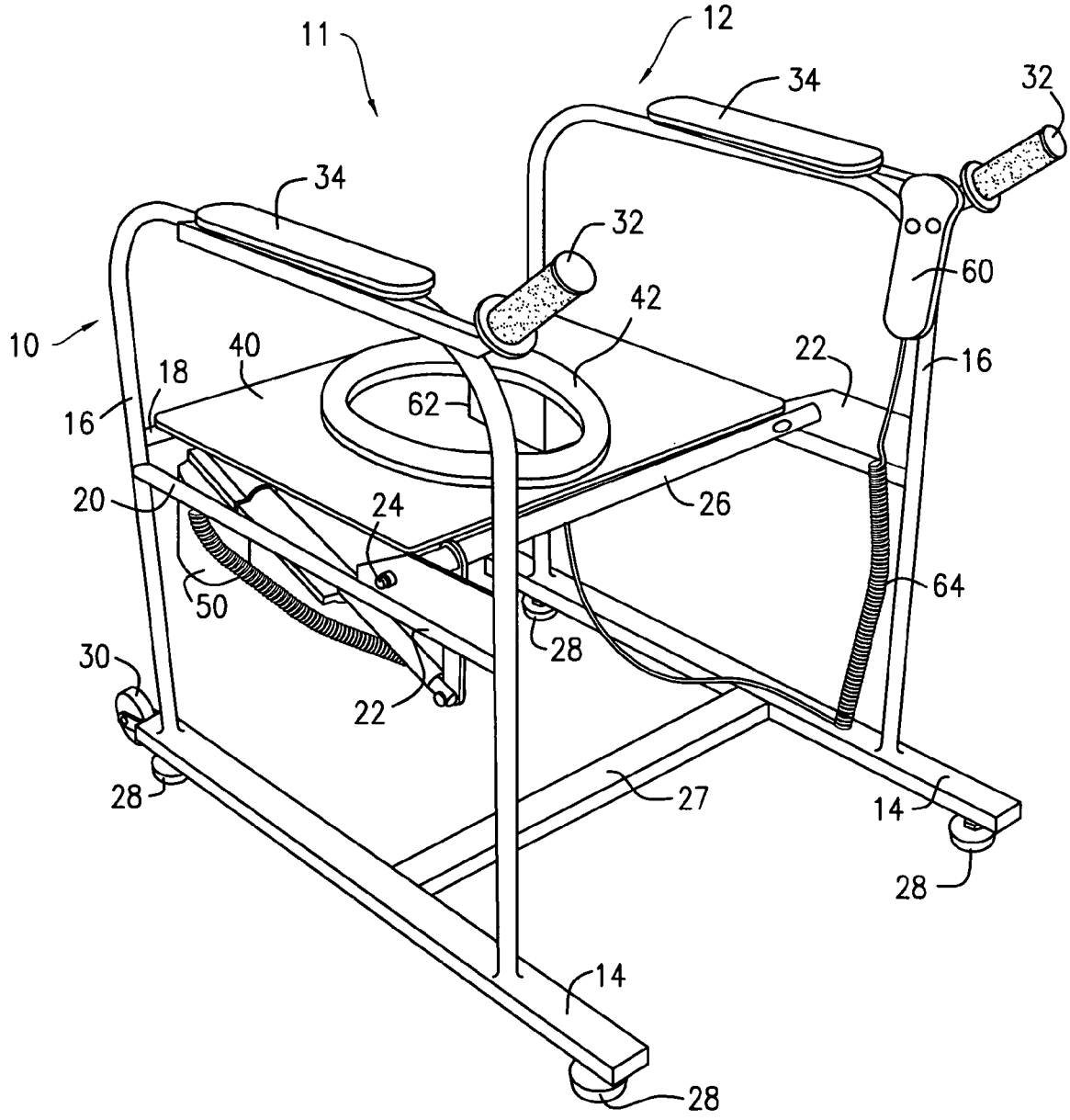
FIGS. 1 and 2 are pictorial views of a roll-about powerized toilet seat lift constructed in accordance with the present invention.

In the Drawings, the apparatus of the invention to assist a handicapped person in this manner is intended for employment when using a toilet having a raisable toilet seat. The apparatus includes a frame 11 having left and right sides 10, 12 upwardly extending from individual ones of a pair of support legs 14 running front to back. Each side is in the form of a substantially U-shaped member 16, between the two of which a first transverse bar 18 extends from left-to-right at the rear of the frame. Similar transverse bars 20 extend along the U-shaped member 16 front-to-back, in respectively supporting a pair of shelves 22 thereupon. Such shelves 22 are apertured, as at 24, to receive a further transverse bar 26 arranged generally parallel to the transverse bar 18, and generally co-planar with it. Adjustable pairs of feet 28 extend downwardly from each of the support legs 14 for resting the frame on a floor surface. A pair of wheels, casters or similar such mechanisms 30 rearwardly projecting from the support legs 14 allow the frame to be rolled about upon being pushed. To facilitate this, a pair of handles 32 project forwardly from individual ones of the U-shaped members 16. These handles 32 allow for a lifting of the frame 11, and for a pushing of it rearwardly about the surfaces afforded by the rollers 30. As will be appreciated, the frame members may be constructed of aluminum or tubular steel. A pair of armrests 34 are included atop the frame for user comfort once the frame is moved into position. A further bar 27 between the legs 14 adds stability to the frame 11.

In accordance with the invention, a platform incorporating an integral toilet seat is included to span between the left and right sides 10, 12 of the frame. The platform, shown at 40, is of a depth to rest upon the rear transverse bar 18 and to couple with the transverse bar 26 when in a horizontal, or lowered position, as in FIG. 1. The integral toilet seat shown at 42 likewise is then in a horizontal plane, to be sat upon. As will be appreciated, the frame and the platform 40 are selected of a depth to align the integral toilet seat 42 over the bowl of the toilet with its toilet seat raised once the frame is rolled into its appropriate position for use.

Figure 2:
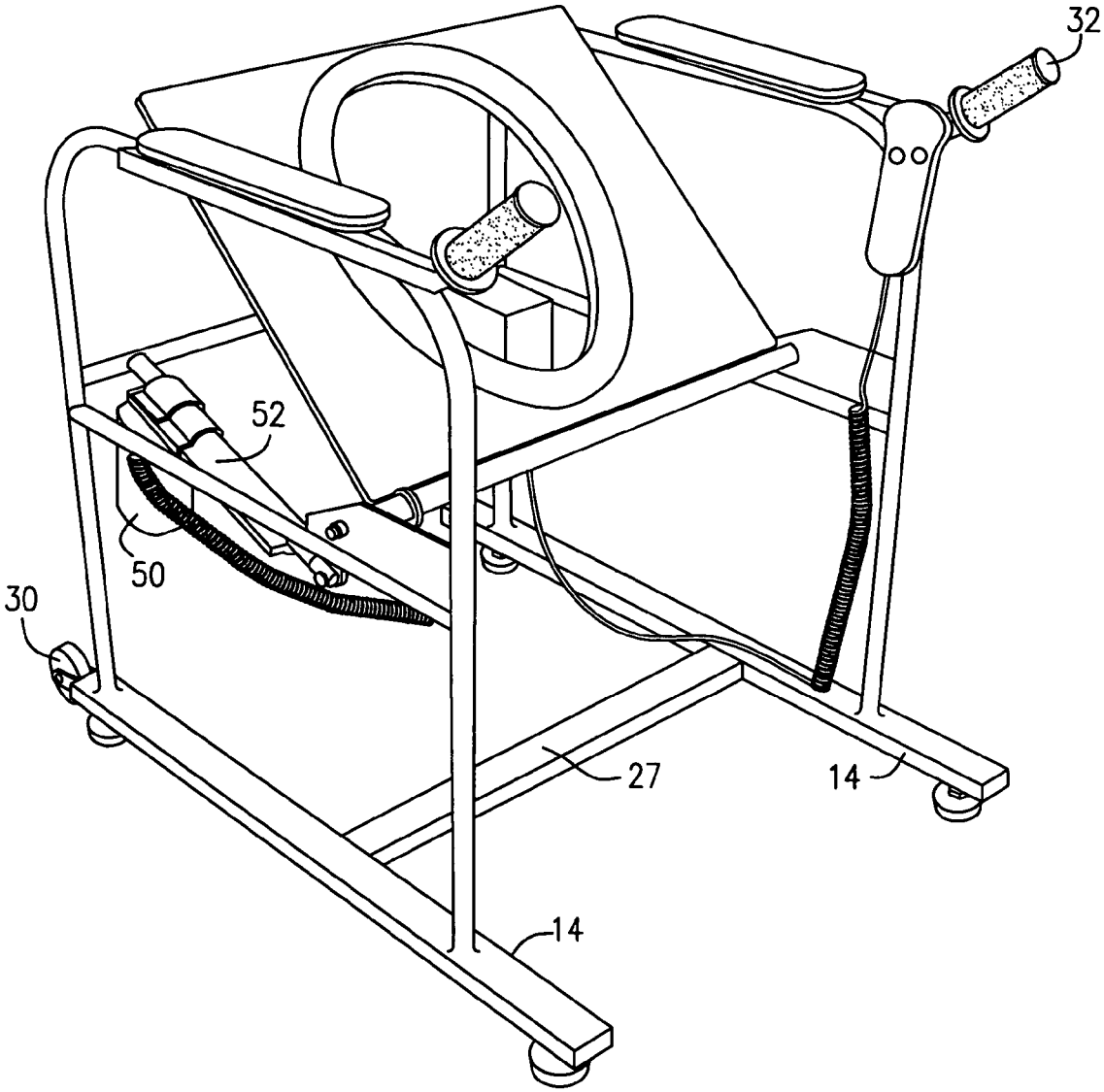
Figure 3:
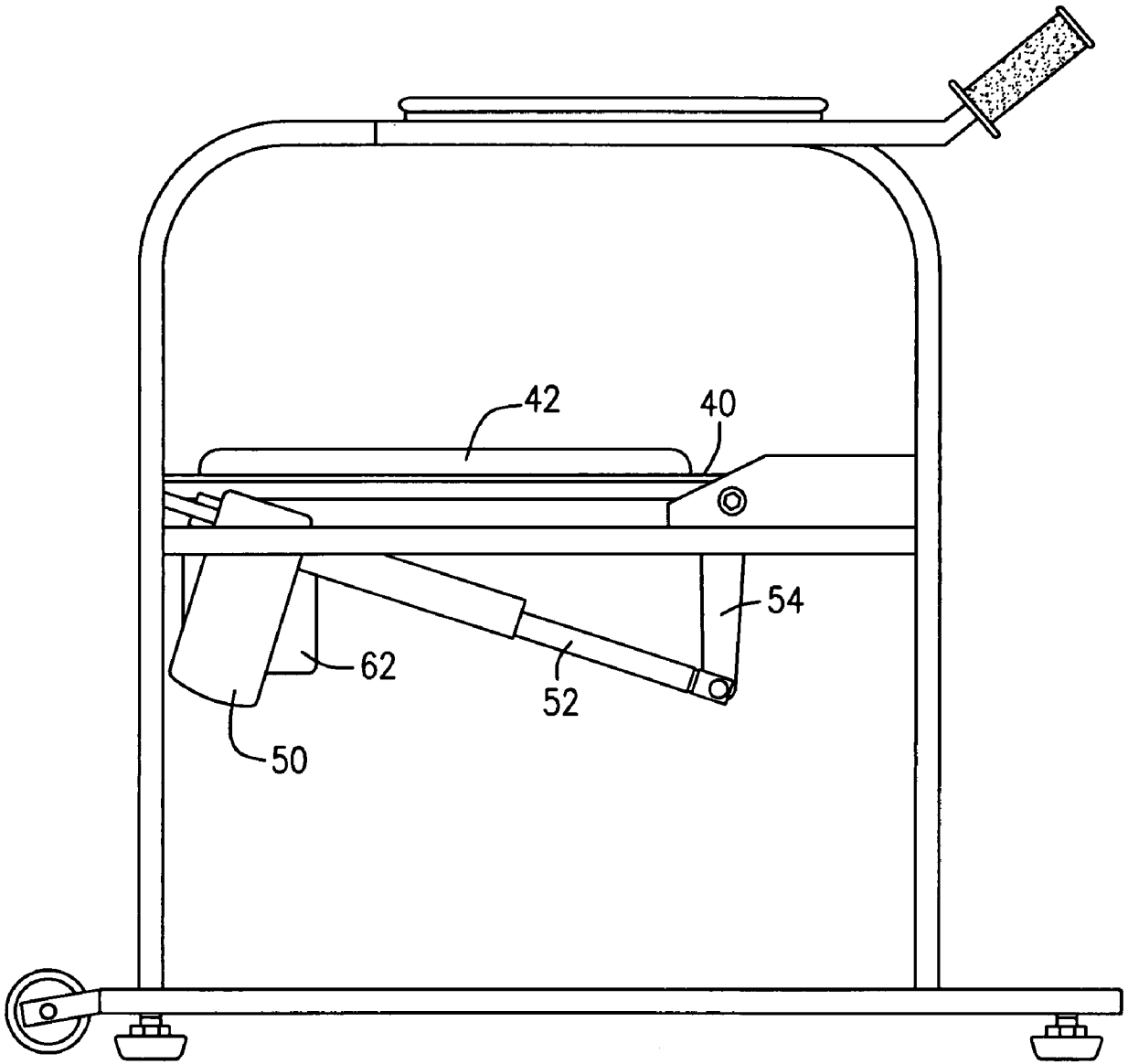
FIGS. 3, 4 and 5 are left, right and top views of the lift of FIGS. 1 and 2 helpful in an understanding of its operation.
Figure 4:
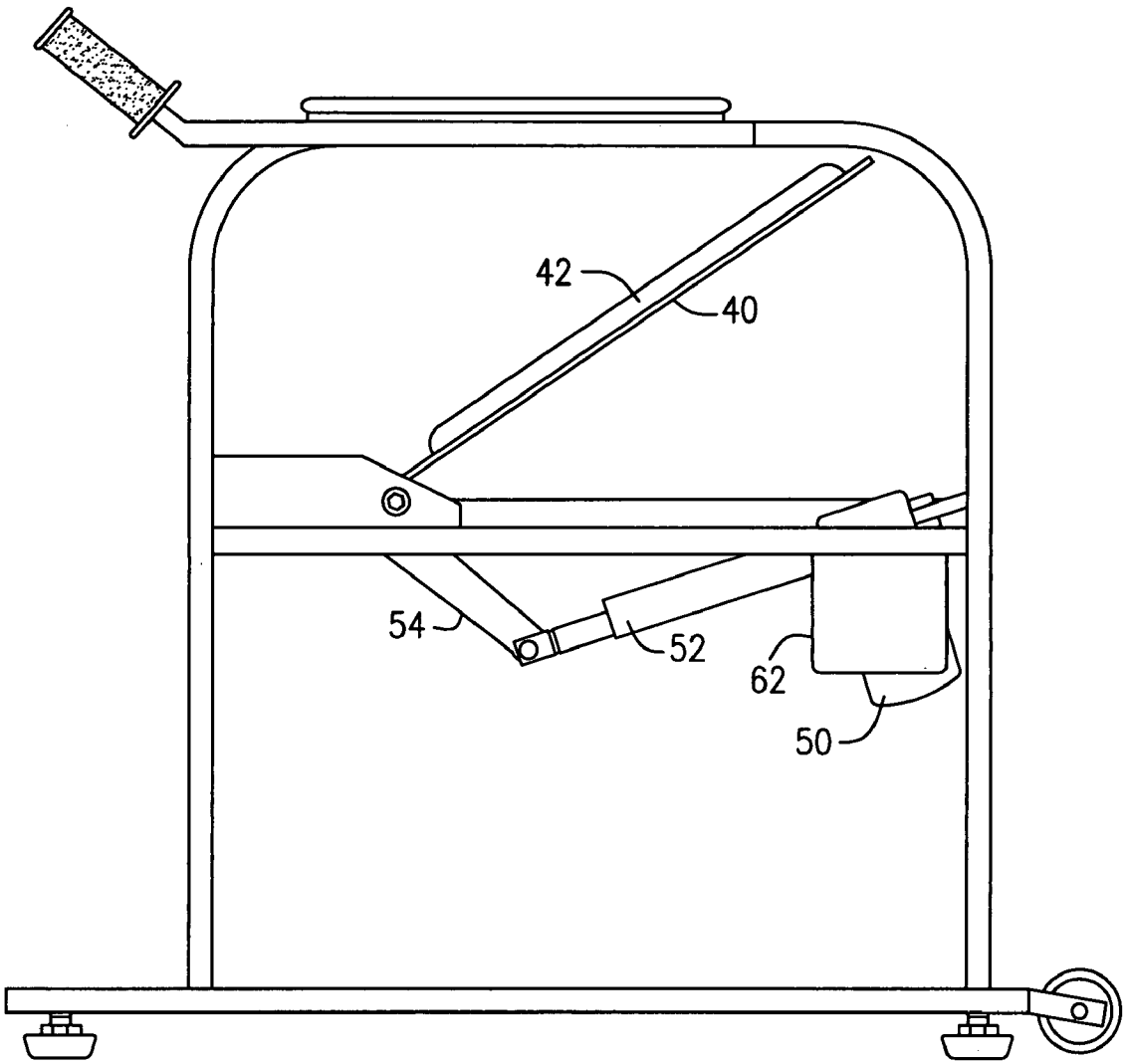

To rotate the platform upwardly to assist the handicapped person in getting up from the toilet seat 42, a motor 50 and a linear actuator 52 are utilized, along with a single linkage 54 coupled with the transverse bar 26. In the quiescent position of FIG. 1 and in the left-side schematic view of FIG. 3 with the motor off, the motor 50, the actuator 52 and the linkage 54 cooperate to place the transverse bar 26 in position to retain the platform 40 in its horizontal orientation while the toilet is being used. With a powering of the motor 50, the linear actuator 52 and the linkage 54 cooperate to rotate the transverse bar 26 in raising the platform 40 from back to front to the position shown in FIG. 2 and in the schematic right side view of FIG. 4—typically to 45°. Energization of the motor 50 is by way of a momentary on-off power switch 60 coupled with one of the left and right U-shape frame members 16 working through an electrical control box 62. Such switch 60 may be at the end of a coiled electrical line 64 to allow a nurse, for example, to assist the handicapped person by himself/herself energizing the motor from a spaced distance. This rotation of the platform 40 will be seen to be in a direction to assist the user-patient in getting off from the toilet with a minimum of stress on the hips and knees.

Once the apparatus of the invention has thus been utilized and the handicapped person relocated, the apparatus can simply be pulled away from the toilet by means of the handles 32, which can then be easily lifted in turning the frame about, and moving the apparatus to the next location for use. With the simple linkage employed for rotating the platform 40 and its integral toilet seat 42, a compact, lightweight construction can be had to facilitate this moving, and even to pull or push the apparatus up, or down, a flight of stairs to the next location where its use is required. In such manner, the apparatus of the invention is particularly useful for use in a hospital, nursing home or assisted care facility.

Figure 5:
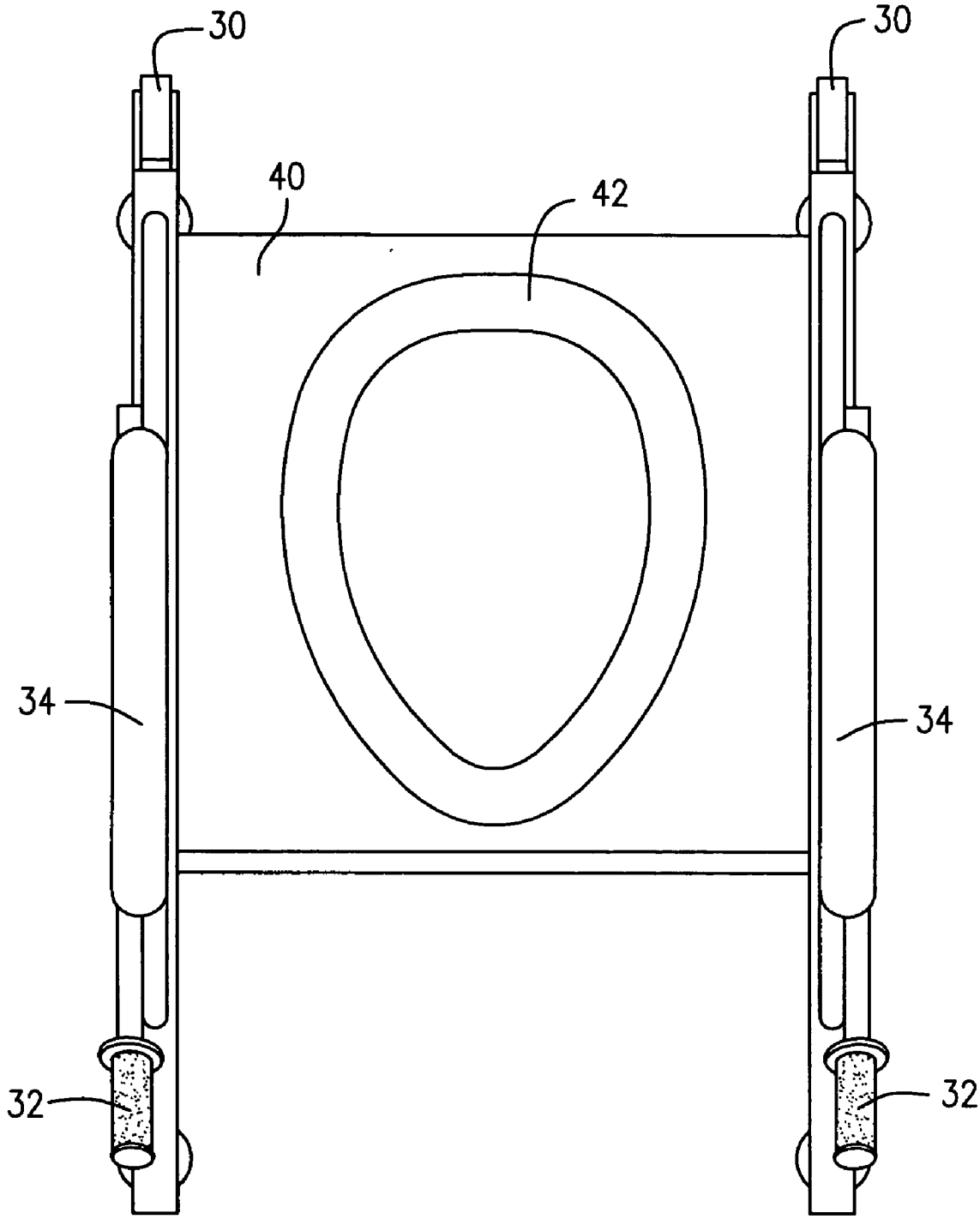
Figure 6:
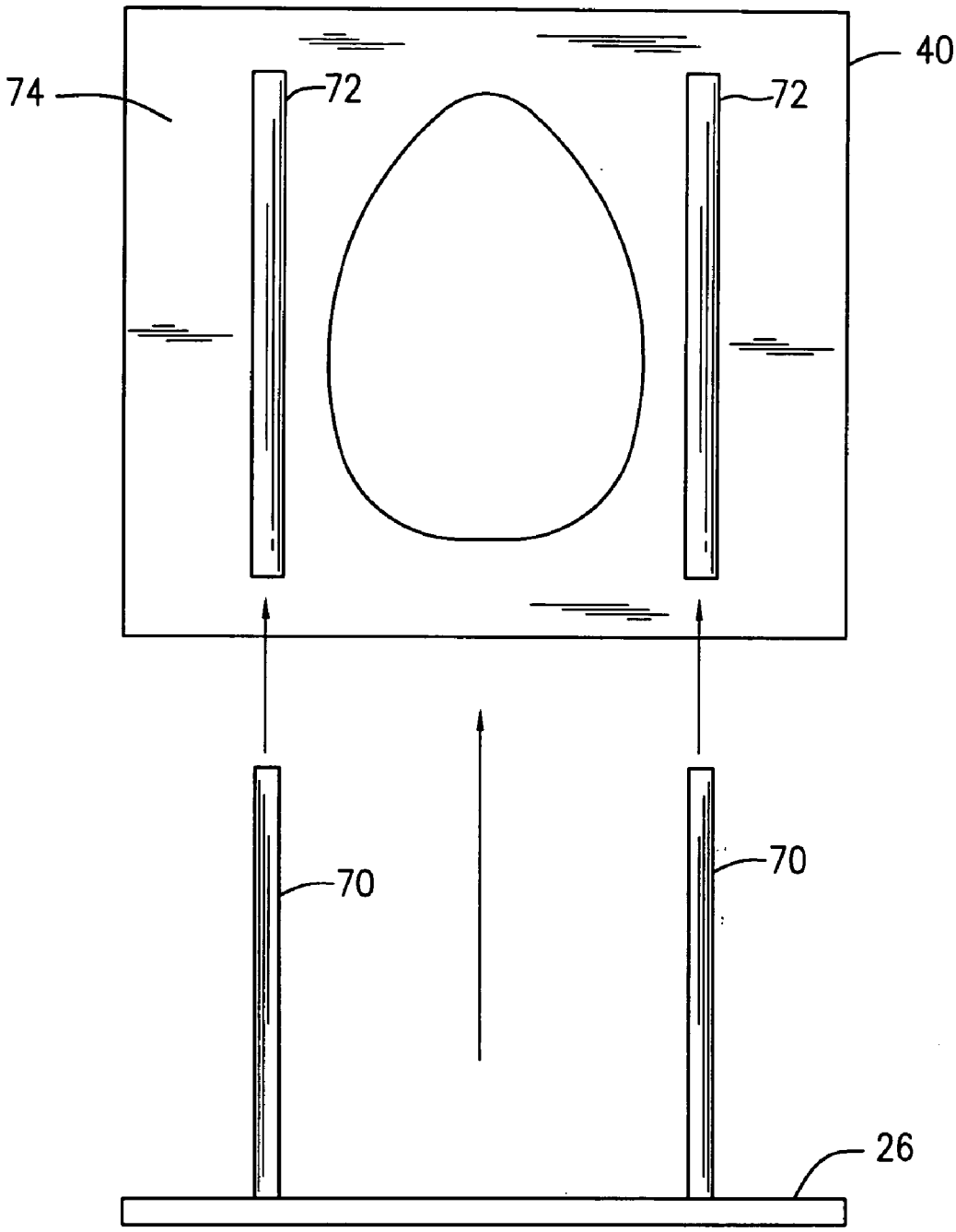
FIG. 6 illustrates a manner of coupling the platform and its seat to the lift's frame, in a utilization of its workings.

While FIG. 5 illustrates a top view of the frame 11 with the platform 40 in its lowered position, FIG. 6 shows one manner of coupling the platform 40 with the rotatable transverse bar 26. A pair of projections 70 rearwardly extend from the bar 26 to couple with a pair of forwardly extending channels 72 or receptacles at an underside 74 of the platform 40. Such arrangement is particularly useful for detaching the platform 40 from the transverse bar 26 to facilitate a separate cleaning of the platform 40 and its integral seat 42 where multiple patient use is of concern. As will be appreciated, numbers of projections or channel receptacles other than pairs may be employed in this regard—with the platform 40 again being of aluminum or steel construction, with the integral toilet seat 42 being of plastic.

While there have been described what are considered to be preferred embodiments of the present invention, it will be readily appreciated by those skilled in the art that modifications can be made without departing from the scope of the teachings herein. Whether wheels or casters are employed as the rollers 30, and whether the rotation of the platform 40 is accomplished through the simple linkage configuration of FIGS. 1–4 or of the more complex arrangements described in the prior art, for example, the apparatus of the invention will be seen to continue with the only requirement being that the platform 40 be able to be positioned at the proper height above an existing toilet whose seat has been raised, and be of a depth to overlie its bowl, being moveable into appropriate position before use. Similarly, the on-off power switch 60 could be oriented with respect to the frame members 16 for foot control of the electrical control box 62 as well as for hand control, whichever may be desired. With the platform rotation of the invention or with the more complicated ones of the prior art, the end result will still be an ability to assist a handicapped person in using a toilet. For at least such reason, therefore, resort should be had to the claims appended hereto for a true understanding of the scope of the invention.

I claim:

1. Apparatus for assisting a handicapped person in using a toilet having a raisable toilet seat, comprising:

a frame having left and right substantially U-shaped sides upwardly extending from individual ones of a pair of support legs running front-to-back in forming a pair of arms for the apparatus;

a pair of armrests atop said frame individually connected with said arms at said left and right sides of said frame;

a first transverse bar extending between paid left and right sides of said frame at a rearward location thereof;

a second transverse bar extending betwen said left and right sides of said frame forwardly of said rearward location;

a platform coupled with said second transverse bar and incorporating an integral toilet seat resting upon said first transverse bar between said left and right sides of said frame;

means coupled with said frame and said second transverse bar for rotating said second transverse bar about a pivot point to rotate said platform upwardly at an angle from back to front without moving said arms and armrests;

first and second handles forwardly projecting from individual ones of said left and right frame sides adjacent top portions thereof; and means rearwardly projecting from individual ones of said support legs for rolling said frame rearwardly about upon lifting said handles and pushing said frame.

2. The apparatus of claim 1 wherein said platform is of a height above said support legs to fit said platform over said toilet once pushed in place when said raisable toilet seat is raised.

3. The apparatus of claim 2 wherein said frame is of a depth to align said integral toilet seat over said toilet upon rolling said frame into predetermined position.

4. The apparatus of claim 3 wherein said frame additionally includes a shelf rearwardly extending from each of said left and right sides of said frame at front portions thereof, and wherein said second transverse bar extends between facing apertures of said shelves as said pivot point upon upwards rotation of said platform.

5. The apparatus of claim 4, also including third and fourth transverse bars from front to back of individual ones of said left and right frame sides for supporting said shelves.

6. The apparatus of claim 5, additionally including a fifth transverse bar spanned between said support legs for stabilizing said frame when a handicapped person sits atop said platform.

7. The apparatus of claim 6, also including first and second pairs of feet downwardly extending from respective ones of front and rear ends of said support legs.

8. The apparatus of claim 7 wherein said rearwardly projecting means includes a pair of wheels, individually projecting from said rear ends of said support legs.

9. The apparatus of claim 7 wherein said pairs of feet are individually rotatably adjustable for stabilizing said frame when said platform is sat upon.

10. The apparatus of claim 2 wherein said first and second transverse bars are substantially coplanar.

11. The apparatus of claim 2 wherein said toilet seat is detachably coupled with said platform.

12. The apparatus of claim 4 wherein said platform includes a pair of forwardly extending channels at an underside thereof to individually receive and detachably couple with a pair of projections rearwardly extending from said second transverse bar.

13. The apparatus of claim 12, also including first and second pairs of feet downwardly extending from respective ones of front and rear ends of said support legs.

14. The apparatus of claim 13 wherein said rearwardly projecting means includes a pair of wheels, individually projecting from said rear ends of said support legs.

15. The apparatus of claim 4 wherein said platform rotating means includes a motor and linear actuator controllable by a power switch at the end of a coiled electrical line.

16. The apparatus of claim 15 wherein said power switch is coupled with one of said left and right frame sides oil filling said cavity to at least 95 percent of the volume thereof.

17. The apparatus of claim 15 wherein said power switch is at the end of coiled electrical line a spaced distance from said frame.

* * * * *